US009259638B2

(12) United States Patent
Reguis et al.

(10) Patent No.: US 9,259,638 B2
(45) Date of Patent: Feb. 16, 2016

(54) FASTENING DEVICE FOR GLIDING BOARD AND BOARD EQUIPPED WITH SUCH A DEVICE

(71) Applicant: Skis Rossignol, Saint-Jean-de-Moirans (FR)

(72) Inventors: Adrien Reguis, Grenoble (FR); Arnaud Repa, Le Fontanil-Cornillon (FR); Vincent Gelin, Mennecy (FR)

(73) Assignee: Skis Rossignol, Saint Jean de Moirans (FR)

( * ) Notice: Subject to any disclaimer, the term of this patent is extended or adjusted under 35 U.S.C. 154(b) by 0 days.

(21) Appl. No.: 13/852,557

(22) Filed: Mar. 28, 2013

(65) Prior Publication Data

US 2013/0257017 A1 Oct. 3, 2013

(30) Foreign Application Priority Data

Mar. 29, 2012 (FR) ..... 12 52863

(51) Int. Cl.

| | |
|---|---|
| ***A63C 10/22*** | (2012.01) |
| ***A63C 10/18*** | (2012.01) |
| ***A63C 10/16*** | (2012.01) |
| ***A63C 10/00*** | (2012.01) |
| ***A63C 10/20*** | (2012.01) |
| ***A63C 5/12*** | (2006.01) |

(52) U.S. Cl.

CPC ..... *A63C 10/18* (2013.01); *A63C 5/128* (2013.01); *A63C 10/20* (2013.01); *A63C 10/22* (2013.01)

(58) Field of Classification Search

CPC ..... A63C 10/00; A63C 10/14; A63C 10/145; A63C 10/16; A63C 10/18; A63C 10/20; A63C 10/22

USPC ..... 280/14.21, 14.22, 14.24, 629, 630, 280/11.14, 11.15, 11.3, 11.31, 11.224, 607, 280/611, 614, 615, 620, 623

See application file for complete search history.

(56) References Cited

U.S. PATENT DOCUMENTS

| | | | | | |
|---|---|---|---|---|---|
| 3,953,041 | A | * | 4/1976 | Buss | 280/11.26 |
| 4,836,571 | A | * | 6/1989 | Corbisiero | 280/600 |
| 5,513,863 | A | * | 5/1996 | Klamer et al. | 280/11.27 |
| 5,836,592 | A | * | 11/1998 | Chang | 280/11.26 |

(Continued)

FOREIGN PATENT DOCUMENTS

| | | | |
|---|---|---|---|
| DE | 20 2006 018 281 | U | 3/2007 |
| EP | 0 823 268 | A | 2/1998 |

(Continued)

OTHER PUBLICATIONS

Search Report issued by French Patent Office for priority application FR 1252863dated Dec. 3, 2012.

*Primary Examiner* — Joseph Rocca
*Assistant Examiner* — Travis Coolman
(74) *Attorney, Agent, or Firm* — Frommer Lawrence & Haug LLP

(57) ABSTRACT

A fastening device for a sliding board includes a base that defines a housing in which a shoe is designed to be immobilized by a maintaining device. The maintaining device includes a vertical locking pivot cooperating with an anchor element secured to the board on the one hand, and with rotational blocking elements on the other hand. The base includes a lower plate and an upper plate to support the shoe and sliding relative to one another, the pivot ensuring sliding locking of the two plates.

16 Claims, 4 Drawing Sheets

(56) References Cited

U.S. PATENT DOCUMENTS

| | | | | |
|---|---|---|---|---|
| 5,876,045 | A * | 3/1999 | Acuna, Jr. | 280/14.24 |
| 6,007,085 | A * | 12/1999 | Rigal et al. | 280/607 |
| 6,089,581 | A * | 7/2000 | Partridge | 280/14.24 |
| 6,099,018 | A * | 8/2000 | Maravetz et al. | 280/624 |
| 6,105,992 | A * | 8/2000 | Schaller et al. | 280/613 |
| 6,145,868 | A * | 11/2000 | Schaller et al. | 280/624 |
| 6,206,402 | B1 * | 3/2001 | Tanaka | 280/607 |
| 6,234,494 | B1 * | 5/2001 | Gien | 280/14.24 |
| 6,315,305 | B1 * | 11/2001 | Gien | 280/14.24 |
| 6,485,035 | B1 * | 11/2002 | Laughlin et al. | 280/14.21 |
| 6,497,420 | B2 * | 12/2002 | Ricci | 280/11.16 |
| 6,520,531 | B1 * | 2/2003 | Gien | 280/618 |
| 6,575,490 | B1 * | 6/2003 | Laughlin | 280/618 |
| 6,669,210 | B2 * | 12/2003 | Chen | 280/11.16 |
| 6,758,488 | B2 * | 7/2004 | Laughlin et al. | 280/624 |
| 6,786,493 | B2 * | 9/2004 | Hong | 280/11.26 |
| 6,808,196 | B2 * | 10/2004 | Des Ouches | 280/636 |
| 6,851,683 | B2 * | 2/2005 | Wegener | 280/11.26 |
| 6,899,349 | B2 * | 5/2005 | Laughlin et al. | 280/624 |
| 6,918,602 | B2 * | 7/2005 | Lu | 280/11.26 |
| 6,945,544 | B2 * | 9/2005 | Feurer et al. | 280/14.22 |
| 6,966,563 | B2 * | 11/2005 | Harrison | 280/14.22 |
| 6,991,240 | B2 * | 1/2006 | Grella et al. | 280/14.21 |
| 7,063,346 | B2 * | 6/2006 | Elkington | 280/618 |
| 7,104,550 | B2 * | 9/2006 | Pascal | 280/14.24 |
| 7,125,025 | B2 * | 10/2006 | Pascal | 280/14.22 |
| 7,287,776 | B2 * | 10/2007 | Papon | 280/636 |
| 7,300,070 | B2 * | 11/2007 | Pelchat | 280/617 |
| 7,334,810 | B2 * | 2/2008 | Holzer et al. | 280/618 |
| 7,407,168 | B2 * | 8/2008 | Lee | 280/11.26 |
| 7,410,177 | B2 * | 8/2008 | Giffin et al. | 280/14.24 |
| 7,490,859 | B2 * | 2/2009 | Coing | 280/817 |
| 7,762,573 | B2 * | 7/2010 | Zaloom et al. | 280/618 |
| 7,980,583 | B2 * | 7/2011 | Zaloom et al. | 280/618 |
| 8,348,284 | B2 * | 1/2013 | Green | 280/11.26 |
| 2001/0013686 | A1 * | 8/2001 | Marmonier | 280/14.21 |
| 2002/0005627 | A1 | 1/2002 | Plassiard | |
| 2003/0042709 | A1 * | 3/2003 | Dodge | 280/618 |
| 2003/0116931 | A1 * | 6/2003 | Quattro et al. | 280/14.21 |
| 2004/0046339 | A1 * | 3/2004 | Chen | 280/11.26 |
| 2004/0094917 | A1 * | 5/2004 | Frigo et al. | 280/11.31 |
| 2004/0207166 | A1 * | 10/2004 | Elkington | 280/14.24 |
| 2005/0051977 | A1 * | 3/2005 | Yiu Lu | 280/11.26 |
| 2006/0091621 | A1 * | 5/2006 | Lin | 280/11.26 |
| 2007/0138766 | A1 | 6/2007 | Couderc | |
| 2009/0174172 | A1 * | 7/2009 | Fumagalli | 280/617 |
| 2013/0234416 | A1 * | 9/2013 | De Huberta Almansa | 280/611 |

FOREIGN PATENT DOCUMENTS

| | | | | |
|---|---|---|---|---|
| EP | 1 464 366 | A | 10/2004 | |
| EP | 1 508 352 | A | 2/2005 | |
| EP | 1 512 442 | A | 3/2005 | |
| ES | 1074122 | U * | 3/2011 | A63C 9/00 |
| FR | 2811583 | A | 1/2002 | |
| FR | 2834909 | A | 7/2003 | |
| FR | 2876041 | A | 4/2006 | |
| WO | WO 02/062433 | A | 8/2002 | |

* cited by examiner

Fig.1
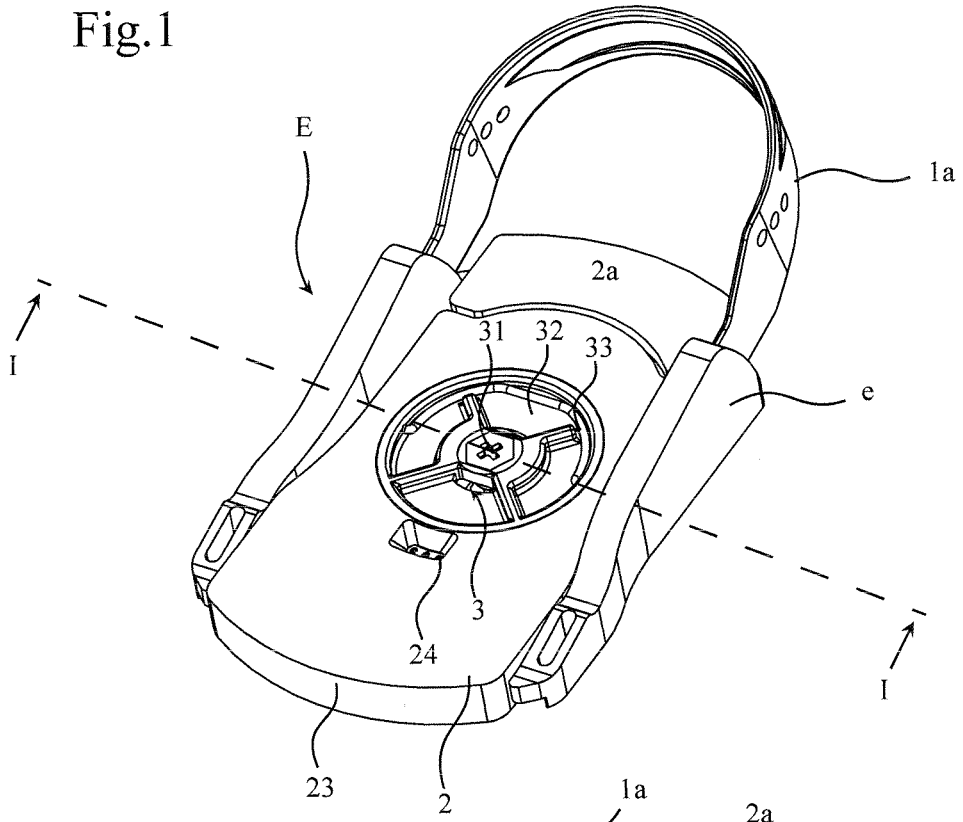
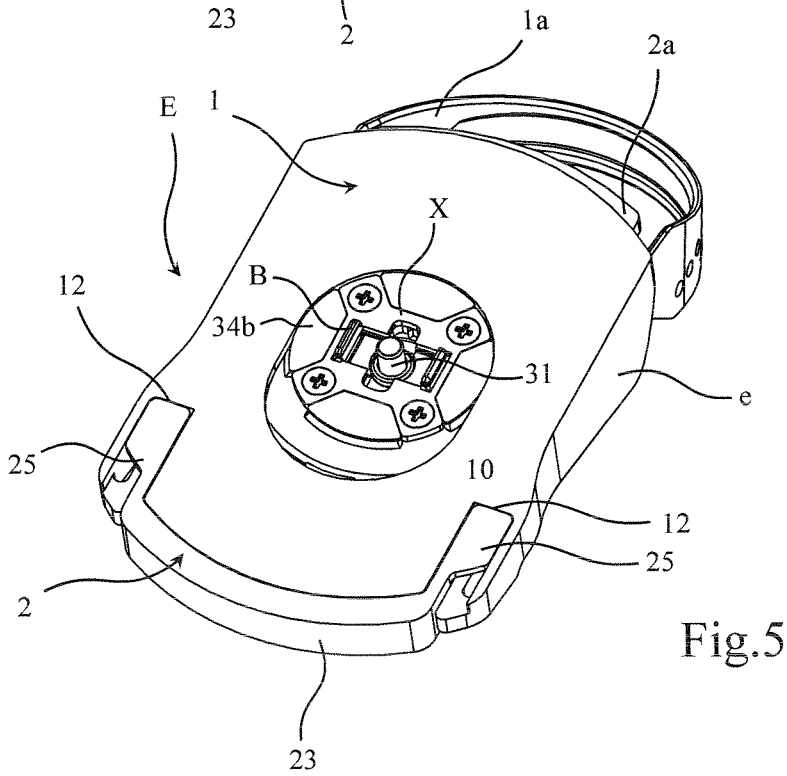
Fig.5

FASTENING DEVICE FOR GLIDING BOARD AND BOARD EQUIPPED WITH SUCH A DEVICE

BACKGROUND

1. Field of the Invention

The present invention relates to a fastening device for a sliding board as well as a board equipped with such a device. In particular, the invention relates to the field of sliding sports, and more particularly to specific arrangements for fastening shoes on a snowboard.

These arrangements are designed to allow manual and easily configurable adjustment for all persons and, in particular, the user, of the fastening depending on the user's shoe size and/or preferred boarding method.

2. Related Art

In general, the snowboard fastening device comprises a base that is designed to be secured to the upper face of the board. The space receives a hoop configured to receive the bearing forces exerted on the rear of the fastener by the user during sliding.

It has already been proposed in documents EP 1,512,442 and FR 2,811,583 to make certain parts of the fastener, and in particular the rear hoop, adjustable in longitudinal translation and/or incline relative to the base to adapt the fastener to different shoe sizes or shapes. This adjustment is particularly useful for rental equipment or when the user must change shoes frequently.

Furthermore, for sliding comfort or style reasons, users wish to be able to adjust the angular position of their shoes relative to the axis of the board and, possibly, the spacing of the feet on the board.

These adjustments are even more sensitive and necessary when the board is to be used indifferently by left-handed and right-handed individuals and/or people of different sizes or degrees of experience.

To that end, it was proposed in FR 2,876,041 and FR 2,834,909 to mount, on the base, a central pivot that allows the rotation of the base, temporarily and only at the end of adjustment. This pivot is designed to be locked, after adjustment, by cooperation with an anchor element secured to the board.

Another adjustment solution was proposed in EP 1,508,352 consisting of making the base in three parts with two telescoping upper plates to make it possible to adapt the fastening area, in contact with the lower part of the shoe, to the shoe size. However, the element for securing and locking the base is not easily accessible, and the solution also does not offer any possibility of angular adjustment incorporating rotational locking.

Furthermore, this document does not examine the rear bearing of the shoe.

SUMMARY

Thus, the existing fastening devices do not make it possible to provide precise adjustment of the angular position and/or adaptation of the housing for the shoes through a simple manual operation.

The aim of the present invention is to resolve these technical problems in a satisfactory and effective manner by proposing an ergonomic solution making it possible to adjust the fastening device easily and quickly so as to adapt to different shoe sizes and customized desires regarding the position of the feet on the board in particular, so as to choose the angular orientation of each of the feet on the board, as well as, optionally, their spacing.

This aim is achieved according to the invention using a fastening device characterized in that said base comprises a lower plate and an upper plate designed to support the shoe and sliding relative to one another, said pivot ensuring sliding locking of the two plates.

According to a first advantageous feature of the invention, at least one of the plates is provided with a first oblong orifice coinciding with a second orifice formed opposite it on the other plate, said orifices being designed to receive said pivot.

According to another advantageous feature, said plates are respectively provided with retaining guideways and guide elements so as to ensure a sliding connection between the two plates.

According to still another feature, one of the plates is provided with lateral flanks extending by a rear hoop.

According to one specific feature, said pivot is provided with a gripping member.

According to one alternative, the upper face of the lower plate is provided with shoe size reference marks.

According to another advantageous feature, at least one of the plates bears rotational locking elements designed to cooperate with complementary elements borne by said pivot.

According to another feature, at least one of said orifices is formed at the center of a cylindrical shoulder bearing, on its perimeter, rotational locking elements.

According to one advantageous alternative, said pivot comprises an upper manual tightening ring extending downward by a threaded axial rod.

According to this alternative, the upper plate preferably has a cavity centered on said orifice and in which all of said tightening ring is housed. Still according to this alternative, it is provided that the anchor element bears a nut screwed on said threaded rod.

According to one specific alternative, said anchor element is made up of a rail offering several longitudinal locking positions of the pivot.

According to another alternative, said pivot comprises a horizontal wedging disc bearing rotational blocking elements.

Preferably, this wedging disc is positioned so as to be inserted between said plates and has, on the upper face thereof, graduations in the form of angular sectors visible through at least one opening formed in the upper plate.

Advantageously, it is provided that said rotational blocking elements are associated with return springs allowing the automatic release of said elements and the rotational adjustment following unlocking of the pivot.

It is possible to provide that the lower plate is extended longitudinally by an extendable skate.

The fastening device according to the invention makes it possible to offer snowboarders adjusting means that are simple, reliable and precise.

These adjusting means make it possible, through a combination of positions of the various component elements, to adjust the placement of the feet in the longitudinal direction and, if necessary, the transverse direction of the base and in different angular orientations after unlocking only the pivot.

This maneuver is done manually and quickly, therefore eliminating the use of any tool and offering the possibility of viewing the selector position precisely and at any time during the adjustment, in particular the angular orientation, and optionally, the length of the base.

Its multiple adjustment possibilities therefore make the fastening device according to the invention particularly suitable for rental equipment, which requires frequent adjustments to different sizes and differing individual desires regarding the position of the feet.

BRIEF DESCRIPTION OF THE FIGURES

The invention will be better understood upon reading the following description, accompanied by the drawings explained hereafter.

FIG. 1 shows a perspective view of one embodiment of a fastening device according to the invention.

FIG. 5 shows a bottom view of the base of the device according to FIGS. 1 to 4.

Figure 6:
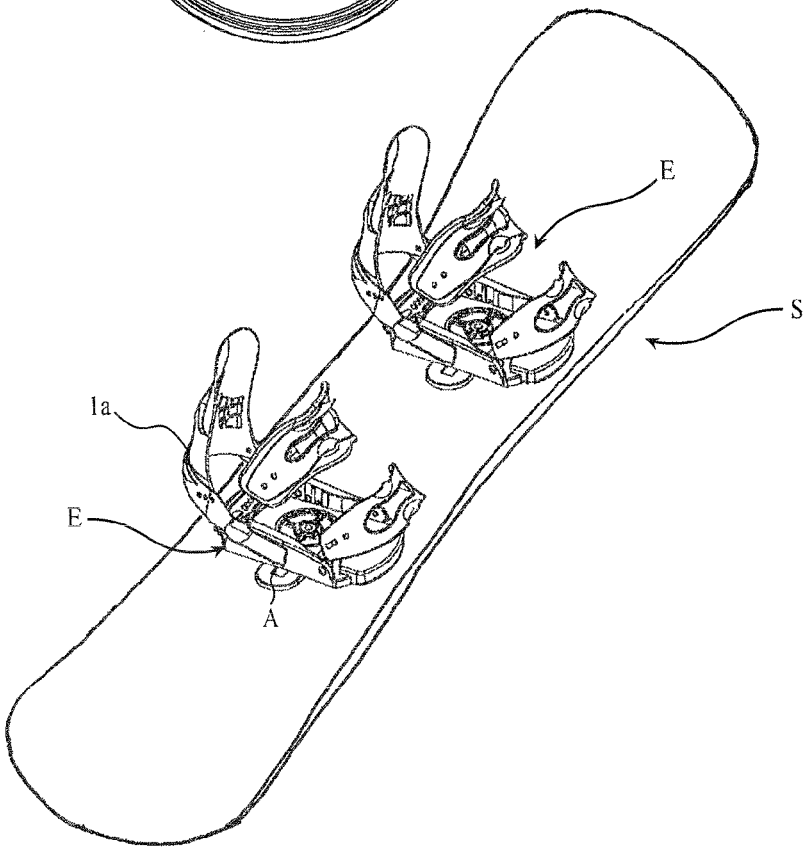
FIG. 6 shows a perspective view of a sliding board equipped with two fastening devices according to the invention.

The fastening device shown in the figures is designed to equip, in pairs, sliding boards such as a snowboard S shown in FIG. 6.

DETAILED DESCRIPTION

Figure 2:
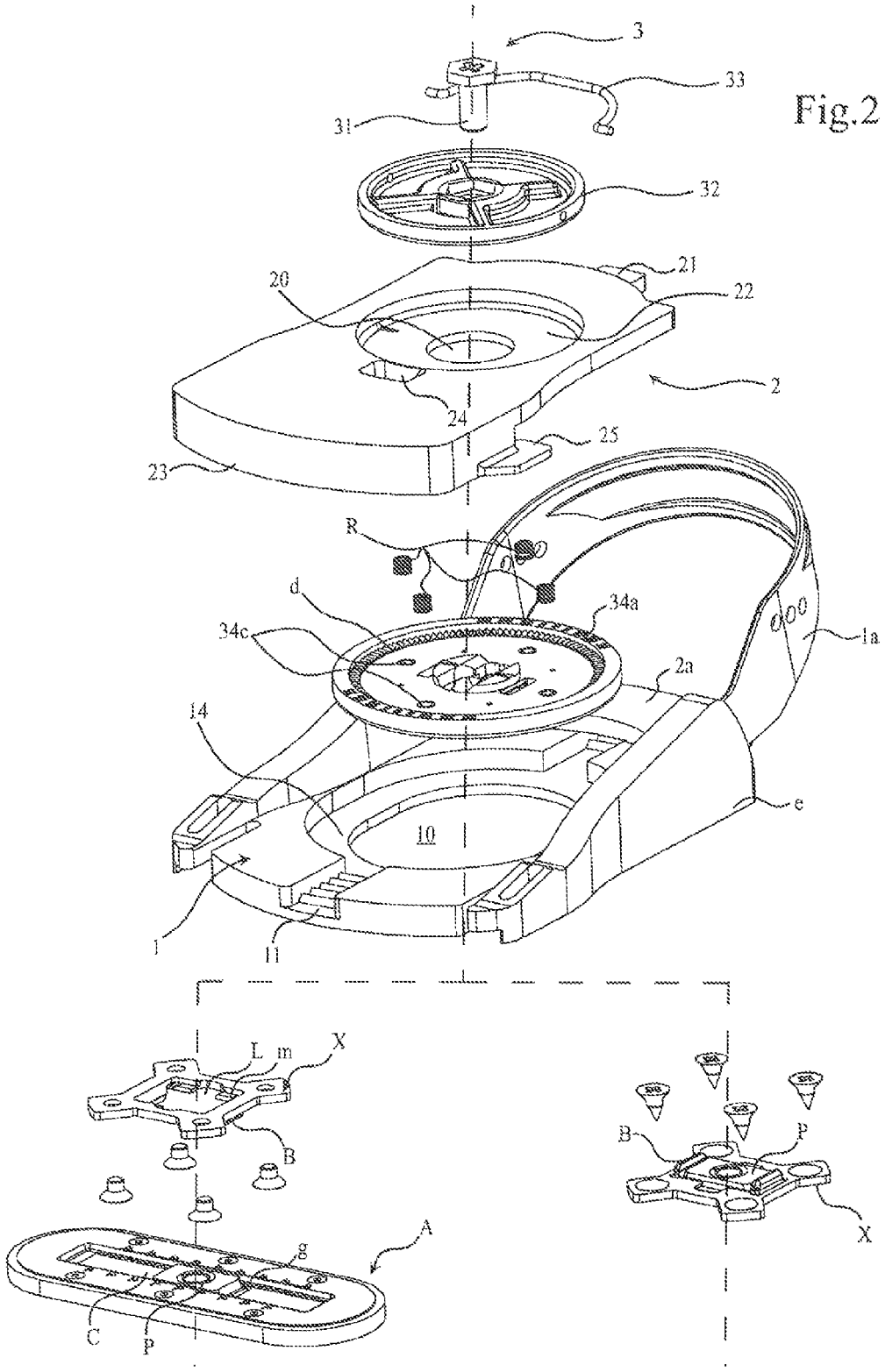
FIG. 2 shows an exploded perspective view of the device of FIG. 1 with two anchoring solutions in the board (right and left views).

As shown in FIGS. 1 and 2, this device assumes the form of a set of parts assembled together (some being able to be disassembled and replaced in the event they become worn), to form a base E delimiting an open housing in which a shoe or boot (not shown) is designed to be immobilized, for example, using maintenance means of the type shown in FIG. 6.

These maintenance means are generally made up of a set of semi-rigid tightening straps or bands provided with stressing means. It would be possible to provide an alternative solution with maintenance means of the automatic or "step-in" fitting means type.

As shown in detail in FIG. 2, the fastening device includes a pivot or lag screw 3 with a vertical axis ensuring complete locking thereof on the board S and cooperating with an anchor element integral with said board on the one hand, and with rotational locking elements that will be described later on the other hand.

In the embodiment of FIGS. 2 (left) and 3, the anchor element is made up of a rail A attached and screwed on the board S or directly integrated into its structure and which offers several longitudinal placement positions for the device for fastening a shoe.

It would be possible, without going beyond the scope of the invention, to provide that the board S is equipped with a single longitudinal rail designed to receive two fastening devices.

According to the alternative illustrated in FIG. 2 (right), the anchor element may also assume the form of a single-position platen.

Figure 3:
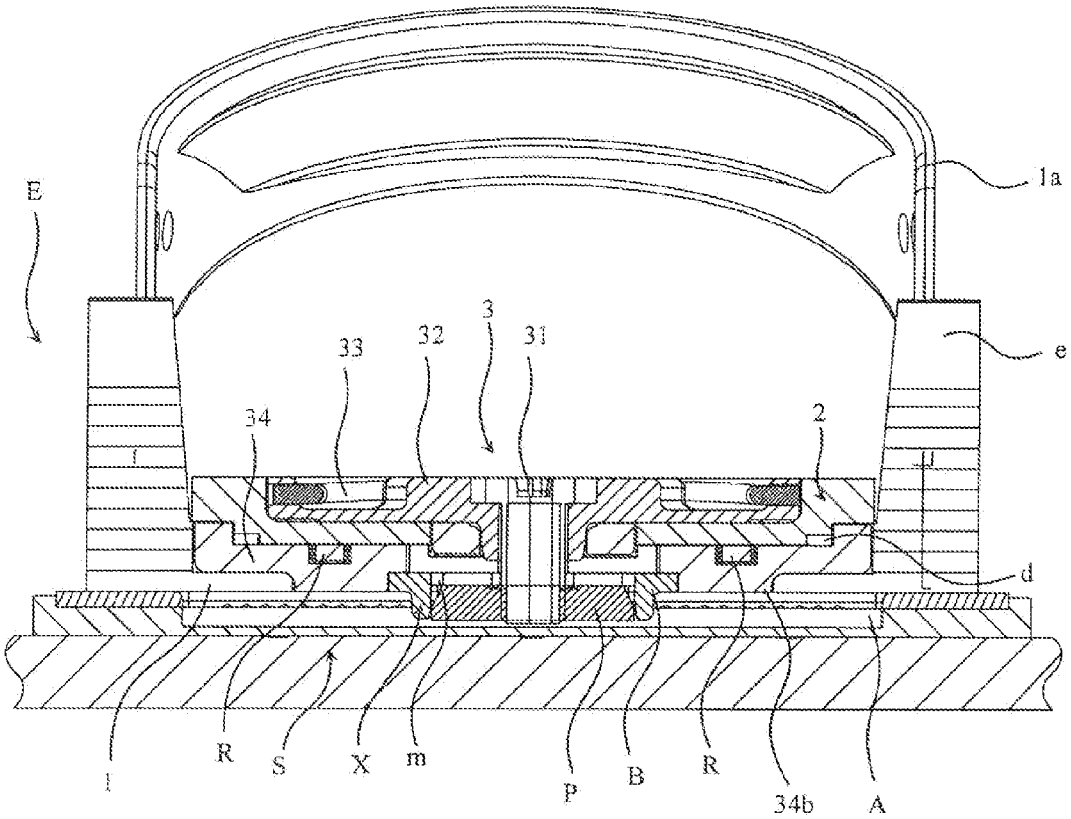
FIG. 3 shows a cross-sectional view along plane I-I of the embodiment of FIGS. 1 and 2.
Figure 4:
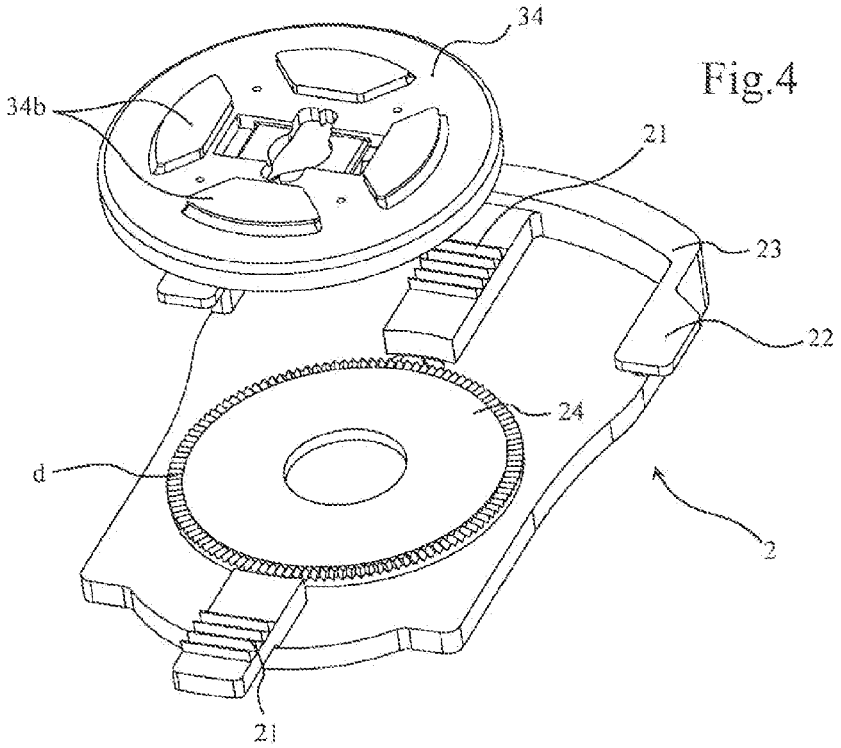
FIG. 4 shows a partial bottom view of the embodiment of FIGS. 1 to 3.

This platen, which is generally made from metal, is made by a journal cross X or simply associated with that cross, which in turn is made from metal (as shown in FIGS. 2, 3 and 5), that will be fixed on the board S by four screws.

Depending on the selected alternative of the invention, the cross X will be mounted on part of the pivot 3 or on the board S, then forming a single-position anchor element, as outlined hereafter.

The base E receives a hoop 1*a* configured to receive the bearing forces exerted on the rear of the fastener by the user during sliding.

This hoop, which generally receives a vertical shell for reacting the rear bearing forces (see FIG. 6), is connected, by its ends, to the lateral portions of the base E. The hoop can be made in a single piece by extending the lateral flanks e of the base or in the form of a piece attached and secured to the base, while being made from a different material and/or with a greater mechanical strength.

According to the invention, the body of the base E comprises a rigid lower plate 1 and upper plate 2, designed to support the shoe and absorb the significant and multidirectional forces created both by the movements of the boarder and the reliefs on the path.

The two plates can slide relative to one another to adjust the length of the housing to the size of the shoes.

The lower plate 1 extends as far as the rear portion of the base to receive the rear portion of the sole of the shoe, while the upper plate 2 extends as far as the front portion of the base to receive the front portion of the sole.

The lower plate 1 and the upper plate 2 overlap, at least in the central portion of the base.

It is, however, possible, according to one alternative not shown here, to provide an intermediate element forming a spacer between the plates and designed in particular to favor the sliding contact thereof.

The lower plate 1 is extended substantially coplanar and longitudinally by a skate 2*a* that is either made in a single piece with the plate 1, or attached and made from a material with damping properties, for example.

The plates 1, 2 are framed by the vertical lateral flanks e, which here are secured to the lower plate 1 and the hoop.

The plates 1, 2 are respectively provided with retaining guideways and guide elements so as to ensure a mutual sliding connection.

The guideways here are made up of longitudinal grooves 11 formed on the upper face of the lower plate 1, along its median axis, while the guide elements are made up of complementary longitudinal ribs 21 supported by the lower face of the upper plate 2 and designed to engage slidingly in the opposite grooves 11.

The dimensions of the grooves and the ribs are adjusted to avoid play between the plates and, in particular, to eliminate risks of angular travel.

One alternative consists of providing the ribs 21 with lateral notches cooperating with the flanks of the grooves 11 so as to limit the number of adjustment positions previously defined.

One alternative consists of providing transverse raised portions regularly spaced on the upper face of the lower plate 1 and/or on the lower face of the upper plate 2 so as to locally, by friction, brake the translation in order to ensure better maintenance of the relative longitudinal position of the plates 1, 2 and, optionally, to indicate to the user that a calibrated position has been reached.

If necessary, the upper plate 2 is also provided with lateral fins 25 that can move in slits 12 of the lower plate 11 to reinforce retention and improve guiding of the two plates relative to one another.

Of course, the sliding of the plates, from front to back, is only possible when the boarder has removed his shoes and the pivot has been unlocked, as will be described hereafter.

Figure 7:
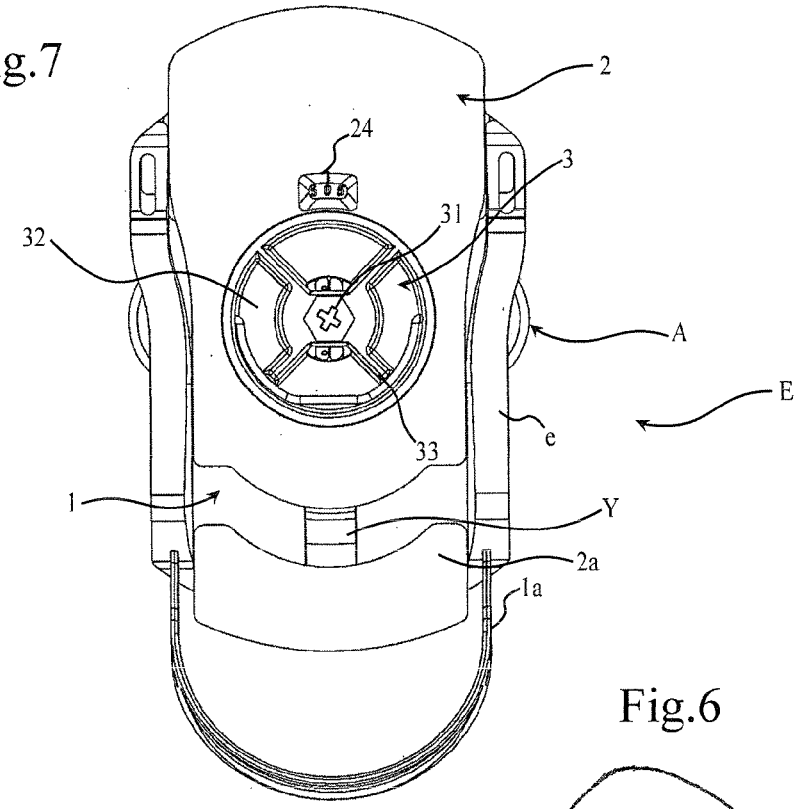
FIG. 7 shows a top view of the fastening device adapted to a large shoe size.

The adjustment to the correct shoe size can be indicated to the user by placing graduations Y (FIG. 7), which may be colored, across from the rear edge of the upper plate 2, said graduations being formed on the upper face of the lower plate 1, in front of the skate 2*a*.

The upper plate 2 includes, at one longitudinal end, a frontal vertical wall 23 abutting with the lower plate 11 in the completely folded position (for the smallest shoe size). The role of the wall 23 is to protect and strengthen the front portion of the device like a bumper.

Its lower edge comes into contact with the board to prevent snow or foreign objects from entering under the base.

In order to allow adjustment of the device, at least one of the plates 1, 2 is provided with a first oblong orifice coinciding with a second orifice formed opposite it on the other plate.

These two orifices are designed to align vertically to receive the pivot 3, which ensures both the connection between the two plates 1, 2 and the mobilization of the fastening device in the anchor element A of the board S.

The pivot 3 thus ensures locking of the base, both in rotation and sliding.

The presence of the oblong orifice offers translational freedom to the lower plate.

In the illustrated embodiment, only the lower plate 1 has an oblong orifice 10, since the orifice 20 of the upper plate 2 is circular.

Thus, the lower plate 1 can be translated forward or backward relative to the upper plate 2, which remains stationary with the pivot.

However, according to other alternatives not shown, it is possible to provide that alternatively, only the upper plate 2 or both plates 1, 2 have oblong orifices; the latter alternative also allowing relative translation of the two plates while offering a greater adjustment length.

According to still another alternative embodiment, the oblong orifice emerges in front of the lower plate and is therefore not completely closed as in the previously described alternatives.

In light of the axial forces to which the fastening device is subjected and to guarantee its complete immobilization on the board during sliding, in particular in the event of slight unscrewing of the pivot, it is provided to reinforce the locking using rotational locking elements.

However, these elements must be released during adjustment operations to allow both the relative movement of the plates 1, 2 and the adjustment of the angular orientation of the base E.

According to one alternative of the invention, it is provided that at least one of the plates bears rotational locking elements designed to cooperate with complementary elements supported by the pivot 3.

Thus, the locking of the pivot 3 alone ensures the rotational blocking of the base E due to the fact that the two plates 1, 2 cannot, due to their structure described above, rotate relative to one another.

Furthermore, the risks of residual play remaining between the two plates 1, 2 that would be detrimental to the proper performance of the boarding are effectively eliminated owing to this arrangement.

At least one of the orifices 10, 20 receiving the pivot 3 is formed at the center of a cylindrical shoulder bearing, on its perimeter, rotational blocking elements.

In the illustrated embodiment, this shoulder 24 is made on the lower face of the upper plate 2 and engages in the central basin formed on the upper face of a wedging disc 34, which in turn also bears complementary rotational locking elements, positioned on its periphery.

The wedging disc 34 here is made in the form of attached piece, positioned perpendicularly and coaxially to the axis of the pivot 3 and so as to be inserted between the two plates 1, 2.

The disc 34 serves to maintain a stationary angular position relative to the anchor element A, and therefore relative to the board S.

This result is for example obtained by providing the disc 34 with a cross X bearing a set of stops B designed to cooperate with the anchor element A to prohibit any rotation of the base once locked.

In FIG. 2, the two stops B protrude downward and are housed in troughs g secured to the nut P, which in turn is held captive in a cage C of the rail A.

The cross X assumes the form of a substantially flat element provided with a central bore delimiting a housing L for the nut P on the one hand, and four peripheral holes designed to receive the mounting screws on the other hand. The housing L has inner flap portions m ensuring retention and/or wedging of the nut P.

In the alternative of FIG. 2 (lower portion seen from the left), the cross X is oriented such that it has stops that protrude downward toward the nut and the screws are then fixed in the disc 34 as shown in FIG. 5. This alternative is designed to mount the fastening device on a board previously provided with an anchor rail.

The alternative of FIG. 2 (lower portion seen from the right) is designed to mount the fastening device on a board with no rail.

The anchor element is then made up of a cross, which in turn is reversible and the position of which on the board must be selected beforehand. In that case, the cross must be screwed in a precise location (in an upside down position with the stops B oriented upward), directly on the board, holding the nut P captive.

Thus, the user can adapt the method for mounting the fastening device according to the invention to the type of board (with or without integrated rail), by simply turning the cross X delivered with the device.

The shape of the cross is not inherently restrictive, and it would similarly be possible to use a circular part such as a washer without going beyond the scope of the invention.

The assembly of the disc, stops and cross could also be made in a single piece.

During assembly of the base, the disc 34 is completely housed in the lower plate 1, resting on a peripheral flat portion 14 formed on the rim of the oblong orifice 10.

In order to best position the disc and facilitate translation of the lower plate 1 in contact therewith, it is provided to attach thereto, on the lower face thereof, bosses **34*b* that penetrate the oblong orifice 10 while coming into contact with walls and which, in the alternative of FIG. 2 (left) and FIG. 5**, cooperate with the cross X.

At least part of the periphery or the upper face of the disc 34 is graduated in angular sectors **34*a* visible through at least one opening 24 formed in the upper plate 2**. Likewise, the upper face of the lower plate is provided with shoe size references.

Thus, by translating the lower plate 1, then progressively rotating the base E, the user can very precisely select a length corresponding to his shoe size as well as the angular orientation of his feet on the board S as a function of his boarding style or desired comfort conditions.

The desired angle will then appear through the opening 24, while the length reference will be visible above the base.

The pivot 3 also comprises an upper manual tightening ring 32 extending downward by a threaded central rod 31.

This ring 32 is completely housed in a cavity 22 centered on the orifice 20 of the upper plate 2 and is provided with a gripping member such as a foldable annulus 33 so as not to hinder the bearing of the sole of the shoe on the upper plate 2.

The end of the threaded rod 31 is screwed, below the base E, into a nut P secured to the anchor element A.

Thus, in the illustrated embodiment, the pivot 3 is structured as a complex assembly of parts assembled to each other (threaded rod 31, ring 32, annulus 33, disc 34, nut P, etc.).

It is, however, possible, without going beyond the scope of the invention, to provide that the pivot 3 is simplified and is reduced to a simpler assembly limited to the threaded rod 31 associated with the gripping member or an assembly formed by a smooth vertical rod associated with a lever bearing cam, in the case of another alternative.

In this simpler case, the disc 34 would no longer be necessary, but the material of the upper face of the lower plate and that of the lower face of the upper plate would be chosen to be skid-resistant so as still to ensure rotational blocking of the assembly.

Secondarily, the upper face of the cavity 22 and the lower face of the ring 32 are provided with wavelets (not shown here) allowing notched tightening and thereby ensuring better retention of the parts relative to one another.

The rotational blocking elements are associated with return means allowing, after unlocking of the pivot 3, their automatic release, and then authorizing rotational adjustment.

In the illustrated embodiment, these return means are made up of four small spiral springs R (FIG. 2), positioned in cylindrical housings 34*c* here formed in the intermediate disc 3. The upper turn of the springs R bears against the lower face of the upper plate 2.

During unscrewing of the pivot 3, the springs R relax and push the upper plate 2 upward, thereby freeing the locking elements opposite them from their mutual engagement.

In the illustrated embodiment, the rotational locking elements are made up of two series of teeth d designed to engage in one another and which are respectively borne by the disc 34 of the pivot 3 and the lower face of the upper plate 2.

The upper face of the base (upper plate 2 and skate 2*a*) is optionally provided with comfort trim made from an elastomer or foam material.

What is claimed is:

1. A fastening device for a sliding board comprising a base that defines a housing in which a shoe is designed to be immobilized by maintaining means that includes a vertical locking pivot linkable with a board, wherein said base comprises a lower plate and an upper plate designed to support the shoe and said pivot comprises a horizontal wedging disk maintained in a stationary angular position relative to the board when the wedging disk is secured to the board, the wedging disk being inserted between the upper plate and the lower plate to allow a simultaneous rotating of both plates around the wedging disk and a sliding displacement of one of the plates relative to the other plate to adjust the length of the housing to the size of the shoe when the pivot is in an unlocked position, said pivot also comprising only one tightening member for tightening the wedging disk and the two plates together on to the board and for simultaneously locking the rotating and the sliding displacement, wherein at least one of the plates is provided with a first oblong orifice coinciding with a second orifice formed opposite it on the other plate, said orifices being designed to receive the wedging disk of said pivot, and wherein at least one of the first oblong orifice or the second orifice is formed at the center of a cylindrical shoulder bearing, on its perimeter, rotational locking elements which cooperates with rotation locking elements realized on one surface of the wedging disk when the pivot is in a locked position.

2. The fastening device according to claim 1 wherein said vertical locking pivot cooperates with an anchor element secured to the board.

3. The fastening device according to claim 2, wherein said anchor element bears a nut screwed on a threaded rod.

4. The fastening device according to claim 1, wherein said plates are respectively provided with retaining guideways and guide elements so as to ensure a sliding connection between the two plates.

5. The fastening device according to claim 4, wherein said guide elements are provided with lateral notches cooperating with said guideways so as to delimit previously defined adjustment positions.

6. The fastening device according to claim 1, wherein the lower plate extends as far as the rear portion of the base to receive the rear portion of the shoe sole while the upper plate extends as far as the front portion of the base to receive the front portion of the shoe sole.

7. A snowboard, which is equipped with a fastening device according claim 1.

8. The fastening device according to claim 1, wherein the tightening member comprises a tightening ring and the upper plate has a cavity centered on said second orifice and in which all of the tightening ring is housed.

9. The fastening device according to claim 1, wherein the rotational locking elements are made up of two series of teeth designed to engage in one another and which are respectively borne by said pivot and one of said plates.

10. The fastening device according to claim 1, wherein one of the plates is provided with lateral flanks extending by a rear hoop.

11. The fastening device according to claim 1, wherein said pivot is provided with a gripping member.

12. The fastening device according to claim 1, wherein the lower plate has an upper face that has shoe size reference marks.

13. The fastening device according to claim 1, wherein at least one of the plates bears rotational locking elements designed to cooperate with complementary elements borne by said pivot.

14. The fastening device according to claim 1, comprising an anchor element made up of a rail offering several longitudinal locking positions of the pivot.

15. The fastening device according to claim 1, wherein an upper face of the wedging disk is graduated in angular sectors visible through at least one opening formed in the upper plate.

16. The fastening device according to claim 1, wherein said rotational locking elements are associated with return springs allowing the automatic release of said elements and the rotational adjustment following unlocking of the pivot.

* * * * *